United States Patent [19]

Okamoto et al.

[11] Patent Number: 4,510,512

[45] Date of Patent: Apr. 9, 1985

[54] HEAT-SENSITIVE RECORD MATERIAL

[75] Inventors: Tosaku Okamoto, Osaka; Tomoyuki Okimoto, Amagasaki; Katsuhiko Ishida, Takatsuki, all of Japan

[73] Assignee: Kanzaki Paper Manufacturing Company, Limited, Tokyo, Japan

[21] Appl. No.: 448,266

[22] Filed: Dec. 9, 1982

[30] Foreign Application Priority Data

| | | | |
|---|---|---|---|
| Dec. 25, 1981 | [JP] | Japan | 56-214692 |
| Feb. 22, 1982 | [JP] | Japan | 57-27818 |
| Jul. 5, 1982 | [JP] | Japan | 57-118090 |

[51] Int. Cl.[3] ..... B41M 5/18

[52] U.S. Cl. ..... 346/209; 346/201; 346/208; 430/945

[58] Field of Search ..... 282/27.5; 428/320.4, 428/320.6, 320.8, 331, 411, 488, 537, 913, 914, 411.1, 488.1, 537.5; 430/945; 346/201, 207–209, 212, 219, 225

[56] References Cited

FOREIGN PATENT DOCUMENTS

| | | | |
|---|---|---|---|
| 2800485 | 7/1978 | Fed. Rep. of Germany | 346/209 |
| 0042910 | 4/1978 | Japan | 346/225 |
| 0118059 | 10/1978 | Japan | 346/207 |
| 0002753 | 1/1979 | Japan | 346/207 |
| 54-121140 | 9/1979 | Japan | 346/209 |
| 0156088 | 12/1980 | Japan | 346/209 |

*Primary Examiner*—Bruce H. Hess

*Attorney, Agent, or Firm*—Armstrong, Nikaido, Marmelstein & Kubovcik

[57] ABSTRACT

A heat-sensitive record material for use with an infrared laser containing (a) a color forming material, (b) a color developing material, and (c) a light absorbing material selected from the group consisting of (1) natural or synthetic silicate compounds, and (2) baked products obtained by baking a zinc compound and a clay mineral at a temperature of at least 500° C.

19 Claims, No Drawings

HEAT-SENSITIVE RECORD MATERIAL

The present invention relates to heat-sensitive record materials, and more particularly to a heat-sensitive record material having a high record sensitivity for use with an infrared laser.

Heat-sensitive record materials are well known which are adapted to form color images by thermally bringing a color forming material into contact with a color developing material which forms a color when reacted with the color forming material by contact. Such heat-sensitive record materials are used for recording generally by scanning the record layer with a recording head (thermal head) in intimate contact therewith which head has a heat emitting element. However, this method is prone to troubles such as wear of the head, adhesion of dust to the head face and sticking of the head to the record layer. Further because the recording speed is dependent on the duration of emission of heat by the thermal head, the method is not amenable to high-speed recording and involves a limitation on the resolution of color images due to the diffusion of heat. Accordingly various non-contact recording techniques have been proposed which use for scanning a laser beam or like light beam having a high energy density in place of the thermal head.

With the techniques wherein heat-sensitive record materials are scanned with a laser beam, a light-heat converting material on the recording device or the record material itself must be caused to absorb the laser beam to convert the energy of the laser beam to thermal energy. However, the method wherein the thermal energy converted by the light-heat converting material of the device is supplied to the record material permits the diffusion or accumulation of thermal energy on the converting material and has difficulties in providing records which are fully useful. On the other hand, usual heat-sensitive record materials are almost unable to absorb visible and near infrared rays in the wavelength range of 400 to 2000 nm, so that with the method in which the laser beam is absorbed directly by the record material, a light absorbing material, such as a color dye, carbon black or metal powder, must be incorporated into the record layer or interposed in the form of a layer between the record layer and the substrate, or the record layer must be covered with a metal evaporation coating which absorbs the laser beam. The record material then has a colored record layer or requires a cumbersome process for production and is not acceptable for use.

Further with attention directed to the fact that usual heat-sensitive record materials absorb infrared light, it has been proposed to use an infrared laser, but useful record sensitivities still remain to be obtained.

An object of the present invention is to provide a heat-sensitive record material having a high record sensitivity for use with an infrared laser.

Another object of the invention is to provide a heat-sensitive record material for an infrared laser which has an uncolored record layer and which can be produced by a simple process.

These and other objects of the invention will become apparent from the following description.

The present invention provides a heat-sensitive record material for use with an infrared laser containing (a) a color forming material, (b) a color developing material, and (c) a light absorbing material selected from the group consisting of (1) natural or synthetic silicate compounds, and (2) baked products obtained by baking a zinc compound and a clay mineral at a temperature of at least 500° C.

Of the components (c) of the invention, natural or synthetic silicate compounds are used as they are or after having been baked at a temperature of at least 500° C. Preferably synthetic silicate compounds are used as baked.

Examples of useful natural silicate compounds are the following minerals.

Olivine group
- olivine [$(Mg,Fe)_2SiO_4$], forsterite ($Mg_2SiO_4$), fayalite ($Fe_2SiO_4$)

Garnet group
- pyrope ($Mg_3Al_2Si_3O_{12}$), almandine ($Fe_3^{2+}Al_2Si_3O_{12}$),
- spessartine ($Mn_3^{2+}Al_2Si_3O_{12}$),
- grossular ($Ca_3Al_2Si_3O_{12}$),
- andradite ($Ca_3Fe_2^{3+}Si_3O_{12}$)

Pyroxene group
- enstatite ($MgSiO_3$), clinoenstatite ($MgSiO_3$),
- diopside ($CaMgSi_2O_6$), hedenbergite ($CaFeSi_2O_6$),
- augite [$Ca(Mg,Fe,Al)(Si,Al)O_6$],
- jadeite ($NaAlSi_2O_6$), spodumen ($LiAlSi_2O_6$)

Pyroxenoid group
- wollastonite ($CaO.SiO_2$),
- rhodonite [$(Mn,Fe,Ca)SiO_3$]

Amphibole group
- anthophyllite [$(Mg,Fe^{2+})_7Si_8O_{22}(OH)_2$],
- cummingtonite [$(Mg,Fe^{2+})_7Si_8O_{22}(OH)_2$],
- grunnerite [$(Fe^{2+},Mg)_7Si_8O_{22}(OH)_2$],
- tremolite [$Ca_2Mg_5(Si_4O_{11})_2(OH)_2$],
- actinolite [$Ca_2(Mg,Fe)_5(Si_4O_{11})_2(OH)_2$],
- hornblende [$NaCa_2(Mg,Fe^{2+},Al)_5(Si,Al)_8O_{22}(OH)_2$],
- glaucophane [$Na_2Mg_3Al_2Si_8O_{22}(OH)_2$],
- riebeckite [$Na_2(Mg,Fe,Al)_5Si_8O_{22}(OH)_2$],
- magnesioriebeckite [$Na_2(Mg,Fe,Al)_5Si_8O_{22}(OH)_2$]

Mica group
- muscovite [$KAl_2(AlSi_3O_{10})(OH)_2$],
- phlogopite [$KMg_3(AlSi_3O_{10})(OH)_2$],
- biotite [$K(Mg,Fe)_3(AlSi_3O_{10})(OH)_2$]

Serpentine group
- chrysotile [$Mg_6Si_4O_{10}(OH)_8$], antigorite [$Mg_6Si_4O_{10}(OH)_8$],
- lizardite [$Mg_6Si_4O_{10}(OH)_8$]

Feldspar group
- [$NaAlSi_3O_8$ (Symbol "Ab"), $CaAl_2Si_2O_8$(Symbol "An")]
- albite [$Ab_{100}An_0$]~[$Ab_{90}An_{10}$], oligoclase [$Ab_{90}An_{10}$]~[$Ab_{70}An_{30}$],
- andesine [($Ab_{70}An_{30}$]~[$Ab_{50}An_{50}$], labradorite [$Ab_{50}An_{50}$]~[$Ab_{30}An_{70}$],
- bytownite [$Ab_{30}An_{70}$]~[$Ab_{10}An_{90}$],
- anorthite [$Ab_{10}An_{90}$]~[$Ab_0An_{100}$]

Feldspathoid group
- nepheline ($NaAlSiO_4$), leucite ($KAlSi_2O_8$),
- eucryptite ($LiAlSiO_4$),
- cancrinite [$Na_8(AlSiO_4)_6(CO_3)_2.2H_2O$],
- sodalite [$Na_8(AlSiO_4)_6Cl_2$],
- helvite [$(Mn,Fe,Zn)_4SSi_3Be_3O_{12}$],
- danalite [$(Be,Fe,Zn,Mn)_7Si_3O_{12}S$]

Other minerals
- willemite ($2ZnO.SiO_2$), phenacite ($Be_2SiO_4$),
- zircon ($ZrSiO_4$), cyanite ($Al_2O.SiO_4$),
- benitoite ($BaTiSi_3O_9$)

Of these specific silicate minerals, olivine group, pyroxene group, amphibole group and plagioclase series of feldspar group are effective in giving improved record sensitivities, can be used in large quantities because of a high degree of whiteness and are therefore preferable to use. Among the preferable minerals, olivine, enstatite, tremolite, actinolite, bytownite and anorthite are especially effective in affording improved record sensitivities, can give more than twice as high a record sensitivity as heretofore possible and are most preferable to use.

Synthetic silicate compounds useful for the invention comprise, as metal element, bivalent or trivalent metal element, such as magnesium, calcium, zinc, barium, aluminum, tin, lead, manganese, iron, nickel, cobalt, etc. The silicate compounds contains at least one of these metal elements. Furthermore, potassium or sodium can be another component element.

Of such synthetic silicate compounds, those containing magnesium, calcium, zinc, barium or aluminum are effective in improving the record sensitivity, can be used in large quantities because of their high degree of whiteness and are therefore especially preferable to use.

Preferably the synthetic silicate compounds are used after having been baked at a temperature of at least 500° C.

In general, silicate compounds are prepared, for example, by adding a soluble metal salt in an aqueous solution of sodium silicate to cause a silicate compound to separate out (hereinafter referred to as a "solution process"), or by baking or melting silicon dioxide and a metal oxide at a temperature of at least 500° C. (hereinafter referred to as a "baking process"). The silicate compounds prepared by the baking process, as well as those prepared by the solution process, are not always fully crystalline depending on the production conditions used. According to the invention, therefore, it is desirable that the silicate compound obtained by the solution process be baked at a temperature of at least 500° C. for crystallization, or that the silicate compound prepared by the baking process, when needed, be baked again at a temperature of at least 500° C. and thereby crystallized to a higher degree. Incidentally natural silicate compounds can be made more crystalline for use by baking. For crystallization or for promoted crystallization, the silicate compound is baked at a temperature of at least 500° C., preferably 700° to 1300° C., more preferably 800° to 1200° C., usually for one to three hours in the presence of air. The baking conditions can be determined suitably according to the kind of silicate compound to be treated, degree of baking, etc.

With the present invention, a baked product obtained by baking a zinc compound and a clay mineral at a temperature of at least 500° C. is used as a light absorbing material. Useful zinc compounds are zinc oxide and compounds which give zinc oxide when heated or baked. While various compounds are known as those giving zinc oxide on heating, zinc hydroxide and zinc carbonate are preferable to use in view of the ease of baking and availability.

Various known minerals are usable as the clay minerals to be baked with zinc compounds. Examples of useful minerals are pyrophyllite, talc, minnesotaite, montmorillonite, nontronite, saponite, vermiculite, sericite, illite, celadonite, amesite, pennine, ripidolite, thuringite, aphrosiderite, kaolinite, dickite, nacrite, metahalloysite, halloysite, sepiolite, palygorskite, attapulgite, etc.

Of these clay minerals, talc, montmorillonite, sericite and kaolinite are advantageous to use since they are effective in achieving the result contemplated by the invention and have a high degree of whiteness.

The zinc compound and the clay mineral are baked under conditions which are suitably adjustable according to the kinds of the materials, etc. Generally about 10 to about 400 parts by weight of the zinc compound is admixed with 100 parts by weight of the clay mineral, and the mixture is baked at a temperature of at least 500° C., preferably 700° to 1300° C., more preferably 800° to 1200° C., for one to three hours in the presence of air.

The light absorbing material (c) of the invention is used usually in the form of a powder, so that the component prepared as above is pulverized by a suitable means, such as a roll mill or impact mill, and, when desired, is further finely divided by a sand mill or the like. The smaller the powder in particle size, the greater is its effect to improve the sensitivity. Accordingly it is desirable to use the component (c) as pulverized to particle sizes of up to 10 $\mu$m, preferably up to 5 $\mu$m. Although the amount of the component (c) to be used is not limited definitely but varies with the intensity of the infrared laser beam to be used, etc., it is generally at least 3% by weight based on the total solids content of the record layer. However, the component (c), if used in an excessively large amount, is likely to result in a color of reduced density, so that the amount is preferably in the range of 3 to 90% by weight, more preferably 10 to 80% by weight.

The heat-sensitive record material of the invention is prepared by coating a substrate with a liquid composition containing dispersed therein at least one kind of each of color forming material, color developing material and specified component (c). The record material can be obtained also by preparing two or three compositions containing dispersed therein the color forming material, color developing material and component (c) respectively and coating a substrate with the compositions in layers. Furthermore, the record material can be produced by impregnating a substrate with some or all of the color forming material, color developing material and component (c), or by making these components and a substrate material into a sheet.

According to the invention, the combination of a color forming material and a color developing material is not particularly limited, insofar as the two components undergo a color forming reaction upon contact with each other. Examples of useful combinations are the combination of a colorless or pale-colored electron donating organic chromogenic material (hereinafter referred to as "basic dye") and an inorganic or organic electron accepting reactant material (hereinafter referred to as "color acceptor"), and the combination of ferric stearate or like higher fatty acid metal salt and gallic acid or like phenol. Furthermore diazonium compounds, couplers and other basic substances are usable in combination. Thus the present invention covers heat-sensitive record materials which comprise such a combination and which are adapted to form visible images (record images) when exposed to heat.

Among various combinations, however, the combination of a basic dye and a color acceptor is espcially preferable because the specific component (c) of the invention, when used with this combination, produces outstanding effects in giving improved record sensitivities and also in eliminating inadvertent formation of color on the record layer before use, namely, fogging.

Various known basic dyes are used as color forming materials in this invention. Examples of useful dyes are:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, etc.

Many compounds are known as the color acceptor that, when heated, contacts the basic dye to generate a color, e.g., inorganic acidic materials including activated clay, acidic clay, attapulgite, bentonite, colloidal silica and aluminum silicate; and organic acidic materials including phenolic compounds such as 4-tert-butylphenol, 4-tert-octylphenol, 4-phenylphenol, 4-acetylphenol, α-naphthol, β-naphthol, hydroquinone, 2,2'-dihydroxydiphenyl, 2,2'-methylenebis-(4-methyl-6-tert-butylphenol), 2,2'-methylenebis-(4-chlorophenol), 4,4'-dihydroxy-diphenylmethane, 4,4'-isopropylidenediphenol, 4,4'-isopropylidenebis(2-tert-buthylphenol), 4,4'-sec-butylidenediphenol, 4,4'-cyclohexylidenediphenol, 4,4'-dihydroxydiphenyl sulfide, 4,4'-thiobis(6-tert-butyl-3-methylphenol), 4,4'-dihydroxydiphenyl sulfone, 4-hydroxybenzoic acid benzylester, hydroquinone monobenzyl ether, novolak phenol resins and phenolic polymers; aromatic carboxylic acids such as benzoic acid, p-tert-butylbenzoic acid, trichlorobenzoic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)-salicylic acid, 3,5-di-tert-butylsalicylic acid, 3-phenyl-5-(α,α-dimethylbenzyl)-salicylic acid, 3,5-di-(α-methylbenzyl)-salicylic acid and terephthalic acid; also, salts of such phenolic compounds or aromatic carboxylic acids with polyvalent metals such as zinc, magnesium, aluminum, calcium, titanium, manganese, tin and nickel.

With the heat-sensitive record materials of the invention, the proportions of color forming material and color developing material to be used for the record layer are not particularly limited but can be determined suitably according to the kinds of color forming material and color developing material. For example when a basic dye and a color acceptor are used, usually 1 to 50 parts by weight, preferably 4 to 10 parts by weight, of the color acceptor is used per part by weight of the basic dye.

For preparing a coating composition comprising the foregoing three components, the color forming material and the color developing material are dispersed, together or individually, into water serving as a dispersion medium, using stirring and pulverizing means such as a ball mill, attrition mill or sand mill. The powder of specific component (c) of the invention is dispersed in the water simultaneously with the above step, or may be added to the resulting dispersion. Usually the coating composition has incorporated therein a binder in an amount of 2 to 40% by weight, preferably 5 to 25% by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc. Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., ultraviolet absorbers such as benzophenone and triazole compounds, defoaming agents, fluorescent dyes, coloring dyes, etc.

To give improved whiteness to the heat-sensitive record layer, kaolin, clay, talc, calcium carbonate, calcined clay, titanium oxide, kieselguhr, finely divided anhydrous silica, activated clay or like inorganic pigment can also be added to the composition. It is also possible to add a sensitizer to the composition. Examples of useful sensitizers are dispersions or emulsions of fatty acid amides such as stearic acid amide, stearic acid methylenebisamide, oleic acid amide, palmitic acid amide, sperm oleic acid amide, coconut fatty acid amide, etc., stearic acid, polyethylene, carnauba wax, paraffin wax, calcium stearate, ester waxes, etc.

The method of forming the record layer of the heat-sensitive record material of the invention is not particularly limited, but conventional techniques are usable. For example, the coating composition is applied to a substrate by an air knife coater, blade coater or like suitable means. The amount of coating composition to be applied, which is not limited particularly, is usually 2 to 12 g/m$^2$, preferably 3 to 10 g/m$^2$, based on dry weight. While papers, synthetic fiber papers, synthetic resin films, etc. are used as substrates, papers are generally preferable to use.

The heat-sensitive record material thus prepared according to the invention is free from undesired color on the record layer, has a very high record sensitivity for use with an infrared laser serving as the recording light source and is usable for high-speed recording which is infeasible in the case of the conventional contact scanning method with a thermal head. Especially when a carbon dioxide gas laser is used as the infrared laser light source, the record material exhibits a remarkably improved record sensitivity, hence outstanding characteristics.

For a better understanding of the advantages of the invention, Examples and Comparison Examples are given below, to which, however, the invention is not limited. The percentages in these Examples are by weight.

EXAMPLE 1

Water was added to 25 g of 3-(N-ethyl-p-toluidino)-6-methyl-7-phenylaminofluoran and 5 g of 10% aqueous solution of polyvinyl alcohol to obtain a dispersion (A) having a solids concentration of 25%. A dispersion (B) having a concentration of 25% was prepared from 100 g of 4,4'-isopropylidenediphenol, 75 g of stearic acid amide, 5 g of 10% aqueous solution of polyvinyl alcohol and water. Another dispersion (C) having a concentration of 25% was prepared by adding water to 200 g of actinolite (2.6 μm in mean particle size) and 200 g of 10% aqueous solution of polyvinyl alcohol. The dispersions (A), (B) and (C) were treated separately in a porcelain ball mill for 8 hours. The three dispersions (A), (B) and (C) were thereafter mixed together to obtain a coating composition, which was then applied in an amount by dry weight of 7 g/m$^2$ to wood-free paper weighing 49 g/m$^2$ and dried to prepare a heat-sensitive record paper adapted to form a black color.

EXAMPLES 2–20

The same procedure as in Example 1 was repeated with the exception of using the silicate materials listed in Table 1 in place of the actinolite used for the dispersion (C) in Example 1 to prepare 19 heat-sensitive record papers for forming a black color.

COMPARISON EXAMPLE 1

The same procedure as in Example 1 was repeated with the exception of not using the actinolite used for the dispersion (C) in Example 1 to prepare a heat-sensitive record paper.

COMPARISON EXAMPLES 2 AND 3

Heat-sensitive record papers were prepared in the same manner as in Example 1 except that the inorganic pigments listed in Table 1 were used in place of the actinolite used for the dispersion (C) in Example 1.

EVALUATION TEST 1

Each of the record papers obtained in Examples 1 to 20 and Comparison Examples 1 to 3 was used for recording thereon with a line density of 10 lines/mm by a carbon dioxide gas laser (output power 1 W, peak wavelength 10.6 μm, beam diameter 100 μm), and the resulting color density was measured by a Macbeth densitometer (Model RD-100R, product of Macbeth Corp.). The recording energy density required for obtaining a color density of 1.0 was determined from the relation between the recording speed and the color density. An amber filter was used for the Macbeth densitometer for the measurement. Table 1 shows the results.

TABLE 1

| | | Light Absorbing Material | Recording Energy Density (J/cm$^2$) (color density = 1.0) |
|---|---|---|---|
| Ex. | 1 | actinolite | 0.42 |
| | 2 | anorthite | 0.46 |
| | 3 | bytownite | 0.48 |
| | 4 | tremolite | 0.51 |
| | 5 | olivine | 0.53 |
| | 6 | oligoclase | 0.57 |
| | 7 | wollastonite | 0.58 |
| | 8 | biotite | 0.60 |
| | 9 | chrysotile | 0.60 |
| | 10 | antigorite | 0.61 |
| | 11 | almandine | 0.65 |
| | 12 | augite | 0.65 |
| | 13 | hornblende | 0.65 |
| | 14 | nepheline | 0.66 |
| | 15 | spessartine | 0.55 |
| | 16 | helvite | 0.47 |
| | 17 | danalite | 0.43 |
| | 18 | enstatite | 0.54 |
| | 19 | spodumen | 0.64 |
| | 20 | zircon | 0.59 |
| Comp. Ex. | 1 | none | 1.1 |
| | 2 | calcium carbonate | 1.2 |
| | 3 | silicon dioxide | 0.96 |

EXAMPLE 21

Water was added to 25 g of 3,3-bis(p-dimethylaminophenyl)-6-dimethylaminophthalide and 5 g of 10% aqueous solution of polyvinyl alcohol to obtain a dispersion (A) having a solids concentration of 25%. Another dispersion (B) having a concentration of 25% was prepared from 100 g of 4,4'-isopropylidenediphenol, 5 g of 10% aqueous solution of polyvinyl alcohol and water. The dispersions (A) and (B) were treated in a porcelain ball mill for 8 hours separately.

A dispersion (C) was prepared by mixing together 250 g of crystalline magnesium metasilicate obtained by baking amorphous magnesium metasilicate (reagent, product of Kishida Kagaku Co., Ltd.) at 800° C. for 3 hours, 15 g of 10% aqueous solution of polyvinyl alcohol and 1000 g of water. The dispersion (C) was treated by a sand mill to reduce the means size of the suspended particles therein to 4 μm.

The three dispersions (A), (B) and (C) thus treated were mixed together, and 100 g of styrene-butadiene-acrylic acid ester copolymer latex (solids concentration 50%) was added to the mixture to obtain a coating composition.

The coating composition was applied in an amount by dry weight of 7 g/m$^2$ to wood-free paper weighing 49 g/m$^2$ and then dried to prepare a blue color forming, heat-sensitive record paper.

EXAMPLE 22

A heat-sensitive record paper was prepared in the same manner as in Example 21 except that crystalline aluminum silicate obtained by baking amorphous aluminum silicate (reagent, product of Kishida Kagaku Co., Ltd.) at 1200° C. for 3 hours was used in place of the magnesium metasilicate employed for the dispersion (C) of Example 21.

COMPARISON EXAMPLE 4

A heat-sensitive record paper was prepared in the same manner as in Example 21 except that unbaked amorphous magnesium metasilicate was used in place of the crystalline magnesium metasilicate employed for the dispersion (C) in Example 21.

COMPARISON EXAMPLE 5

A heat-sensitive record paper was prepared in the same manner as in Example 22 except that unbaked amorphous aluminum silicate was used in place of the crystalline aluminum silicate employed in Example 22.

EXAMPLE 23

A black color forming, heat-sensitive record paper was prepared in the same manner as in Example 21 except that 3-(N-ethyl-p-toluidino)-6-methyl-7-phenylaminofluoran was used in place of the 3,3-bis(p-dimethylaminophenyl)-6-dimethylaminophthalide employed for the dispersion (A) in Example 21.

EXAMPLE 24

A heat-sensitive record paper was prepared in the same manner as in Example 23 except that crystalline calcium silicate obtained by baking amorphous calcium silicate (reagent, product of Kishida Kagaku Co., Ltd.) at 800° C. for 3 hours was used in place of the magnesium metasilicate employed for the dispersion (C) in Example 23.

EXAMPLES 25 TO 27

Three kinds of heat-sensitive record paper were prepared in the same manner as in Example 23 except that crystalline zinc silicate (Example 25), crystalline barium silicate (Example 26) and crystalline nickel silicate (Example 27) obtained by baking amorphous zinc silicate, barium silicate and nickel silicate respectively at 800° C. for 3 hours were used in place of the magnesium metasilicate employed for the dispersion (C) in Example 23.

EVALUATION TEST 2

The heat-sensitive record papers obtained in Examples 21 to 27 and Comparison Examples 4 and 5 were tested for recording energy density in the same manner as in Evaluation Test 1 with the exception of using on the Macbeth densitometer a red filter for Examples 21 and 22 and Comparison Examples 4 and 5, and an amber filter for Examples 23 to 27. Table 2 shows the results.

TABLE 2

| | Recording Energy Density (J/cm$^2$) (color density = 1.0) |
|---|---|
| Ex. 21 | 0.53 |
| 22 | 0.57 |
| Comp Ex. 4 | 1.00 |
| 5 | 1.02 |
| Ex. 23 | 0.57 |
| 24 | 0.52 |
| 25 | 0.46 |
| 26 | 0.50 |
| 27 | 0.53 |

EXAMPLE 28

Water was added to 25 g of 3,3-bis(p-dimethylaminophenyl)-6-dimethylaminophthalide and 5 g of 10% aqueous solution of polyvinyl alcohol to obtain a dispersion (A) having a solids concentration of 25%. Another dispersion (B) having a concentration of 25% was prepared from 100 g of 4,4'-isopropylidenediphenol, 5 g of 10% aqueous solution of polyvinyl alcohol and water. The dispersions (A) and (B) were treated in a porcelain ball mill for 8 hours separately.

A dispersion (C) was prepared by mixing together a product obtained by baking 125 g of kaolinite and 125 g of zinc oxide at 800° C. for 3 hours, 15 g of 10% aqueous solution of polyvinyl alcohol and 1000 g of water. The dispersion (C) was treated by a sand mill to reduce the means size of the suspended particles therein to 4 μm.

The three dispersions (A), (B) and (C) thus treated were mixed together, and 100 g of styrene-butadiene-acrylic acid ester copolymer latex (solids concentration 50%) was added to the mixture to obtain a coating composition.

The coating composition was applied in an amount by dry weight of 7 g/m$^2$ to wood-free paper weighing 49 g/m$^2$ and then dried to prepare a blue color forming, heat-sensitive record paper.

EXAMPLE 29

A heat-sensitive record paper was prepared in the same manner as in Example 28 except that a product obtained by baking talc (125 g) and zinc oxide (125 g) at 1200° C. for 3 hours was used in place of the baked product used for the dispersion (C) in Example 28.

COMPARISON EXAMPLE 6

A heat-sensitive record paper was prepared in the same manner as in Example 28 except that unbaked kaolinite and unbaked zinc oxide were used in place of the backed product used for the dispersion (C) of Example 28.

COMPARISON EXAMPLE 7

A heat-sensitive record paper was prepared in the same manner as in Example 28 except that a product obtained by baking 125 g of kaolinite and 125 g of zinc oxide a 400° C. for 3 hours was used in place of the baked product used for the dispersion (C) in Example 28.

COMPARISON EXAMPLE 8

A heat-sensitive record paper was prepared in the same manner as in Example 29 except that unbaked talc and unbaked zinc oxide were used in place of the baked product used in Example 29.

EXAMPLE 30

A black color forming, heat-sensitive record paper was prepared in the same manner as in Example 28 except that 3-(N-ethyl-p-toluidino)-6-methyl-7-phenylaminofluoran was used in place of the 3,3-bis(p-dimethylaminophenyl)-6-dimethylaminophthalide employed for the dispersion (A) in Example 28.

EXAMPLE 31

A heat-sensitive record paper was prepared in the same manner as in Example 30 with the exception of using kaolinite and zinc carbonate in place of kaolinite and zinc oxide for preparing a baked product similarly.

EXAMPLE 32

A baked product was prepared in the same manner as in Example 30 with the exception of using 125 g of kaolinite, 65 g of zinc hydroxide and 60 g of zinc oxide in place of 125 g of kaolinite and 125 g of zinc oxide. A heat-sensitive record paper was prepared in the same manner as in Example 30 except that the above baked product was used in place of the baked product used in Example 30 for the dispersion (C).

EXAMPLES 33 TO 37

Five kinds of heat-sensitive record paper were prepared in the same manner as in Example 30 except that products obtained by baking the following components were used in place of the baked product obtained by baking kaolinite (125 g) and zinc oxide (125 g) used for the dispersion (C) in Example 30.

Example 33 montmorillonite (125 g)-zinc oxide (125 g)
Example 34 sericite (125 g)-zinc carbonate (125 g)
Example 35 halloysite (125 g)-zinc oxide (125 g)
Example 36 kaolinite (125 g)-zinc hydroxide (125 g)
Example 37 attapulgite (125 g)-zinc oxide (125 g)

EVALUATION TEST 3

The heat-sensitive record papers obtained in Examples 28 to 37 and Comparison Examples 6 to 8 were tested for recording energy density in the same manner as in Evaluation Test 1 with the exception of using on the Macbeth densitometer a red filter for Examples 28 to 29 and Comparison Examples 6 to 8, and an amber filter for Examples 30 to 37. Table 3 shows the results.

TABLE 3

| | Recording Energy Density (J/cm$^2$) (color density = 1.0) |
|---|---|
| Ex. 28 | 0.51 |
| 29 | 0.49 |
| Comp. Ex. 6 | 1.12 |
| 7 | 1.08 |
| 8 | 1.09 |
| Ex. 30 | 0.53 |
| 31 | 0.51 |
| 32 | 0.53 |
| 33 | 0.49 |
| 34 | 0.50 |
| 35 | 0.49 |
| 36 | 0.52 |
| 37 | 0.51 |

Tables 1 to 3 reveal that the heat-sensitive record papers obtained by the invention have high record sensitivities for use with lasers.

We claim:

1. A heat-sensitive record material for use with an infrared laser containing (a) a color forming material, (b) a color developing material, and (c) a light absorbing material selected from the group consisting of (1) natural silicate compounds selected from the group consisting of the olivine group, garnet group, pyroxene group, amphibole group, serpentine group, plagioclase series of fledspar group, feldspathoid group, willemite, phenacite, zircon, cyanite and benitoite, (2) synthetic silicate compounds comprising, as the metal element, at least one of the bivalent or trivalent metal elements selected from the group consisting of magnesium, calcium, zinc, barium, aluminum, tin, lead, manganese, iron, nickel and cobalt and baked at a temlperature of at least 500° C., and (3) baked products obtained by baking a zinc compound and a clay mineral at a temperature of at least 500° C., and (d) the color forming material, color developing material and light absorbing material being dispersed in a binder resin and a color being formed when at least one of the color forming material and color developing material melts by heat.

2. A heat-sensitive record material as defined in claim 1 wherein the natural silicate compound is olivine group, pyroxene group, amphibole group or plagioclase series of feldspar group.

3. A heat-sensitive record material as defined in claim 2 wherein the natural silicate compound is olivine, enstatite, tremolite, actinolite, bytownite or anorthite.

4. A heat-sensitive record material as defined in claim 1 wherein the metal element is magnesium, calcium, zinc, barium or aluminum.

5. A heat-sensitive record material as defined in claim 1 wherein the synthetic silicate compound is magnesium silicate, calcium silicate or zinc silicate.

6. A heat-sensitive record material as defined in claim 1 wherein the silicate compound is natural silicate compound which is baked at a temperature of at least 500° C.

7. A heat-sensitive record material as defined in claim 6 wherein the baking temperature is 700° to 1300° C.

8. A heat-sensitive record material as defined in claim 1 wherein the baking temperature is 700° to 1300° C.

9. A heat-sensitive record material as defined in claim 1 wherein the zinc compound is zinc oxide or a compound which produces zinc oxide when heated.

10. A heat-sensitive record material as defined in claim 9 wherein the zinc oxide producing compound is zinc hydroxide or zinc carbonate.

11. A heat-sensitive record material as defined in claim 1 wherein the clay mineral is pyrophyllite, talc, minnesotaite, montmorillonite, nontronite, saponite, vermiculite, sericite, illite, celadonite, amesite, pennine, ripidolite, thurigite, aphrosiderite, kaolinite, dickite, nacrite, metahalloysite, halloysite, sepiolite, palygorskite or attapulgite.

12. A heat-sensitive record material as defined in claim 11 wherein the clay mineral is talc, montmorillonite, sericite or kaolinite.

13. A heat-sensitive record material as defined in claim 1 wherein about 10 to about 400 parts by weight of the zinc compound is used per 100 parts by weight of the clay mineral.

14. A heat-sensitive record material as defined in claim 1 wherein the zinc compound and clay mineral are baked at a temperature of 700° to 1300° C.

15. A heat-sensitive record material as defined in claim 1 wherein the light absorbing material is used in an amount of at least 3% by weight based on the total solids content of the record layer.

16. A heat-sensitive record material as defined in claim 15 wherein the amount of the light absorbing material is in the range of 3 to 90% by weight.

17. A heat-sensitive record material as defined in claim 16 wherein the amount of the light absorbing material is in the range of 10 to 80% by weight.

18. A heat-sensitive record material as defined in claim 1 wherein the color forming material is an electron donating organic chromogenic material and the color developing material is an electron accepting reactant material.

19. A heat-sensitive record material as defined in claim 1 wherein a carbon dioxide gas laser is used as the infrared laser light source.

* * * * *